United States Patent [19]

De Roeck et al.

[11] 4,385,716

[45] May 31, 1983

[54] WEB CONTROLLING APPARATUS

[75] Inventors: Joseph I. De Roeck, St.Katelijne-Waver; Eric J. Blondeel, Brugge; Lucien A. Christiaen, Wilrijk, all of Belgium

[73] Assignee: AGFA-Gevaert N.V., Mortsel, Belgium

[21] Appl. No.: 221,450

[22] Filed: Dec. 30, 1980

[30] Foreign Application Priority Data

Jan. 1, 1980 [GB] United Kingdom ..... 8000093

[51] Int. Cl.[3] ..... B65H 25/26

[52] U.S. Cl. ..... 226/18; 226/20; 226/97; 226/197

[58] Field of Search ..... 226/15–20, 226/21, 22, 23, 95, 97, 189, 197; 34/16, 156–159

[56] References Cited

U.S. PATENT DOCUMENTS

| | | | |
|---|---|---|---|
| 2,331,030 | 10/1943 | King | 271/2.6 |
| 2,722,415 | 11/1955 | Wood, Jr. | 226/23 |
| 3,826,416 | 7/1974 | Tagaki et al. | 226/22 |

*Primary Examiner*—Leonard D. Christian
*Attorney, Agent, or Firm*—William J. Daniel

[57] ABSTRACT

An apparatus for controlling an outgoing web leaving an air cushion turning bar, which enables a convenient transport of longitudinally curved webs over such air turning bar. The apparatus comprises at least one axially displaceable roller adapted to be moved laterally upon a deviation in the web to bring the same to its outgoing path, and a second roller capable of bodily tilting movement and preferably axial movement as well, to differentially lengthen the path of the web edge margin remote from the direction of deviation.

10 Claims, 14 Drawing Figures

WEB CONTROLLING APPARATUS

Figure 1:
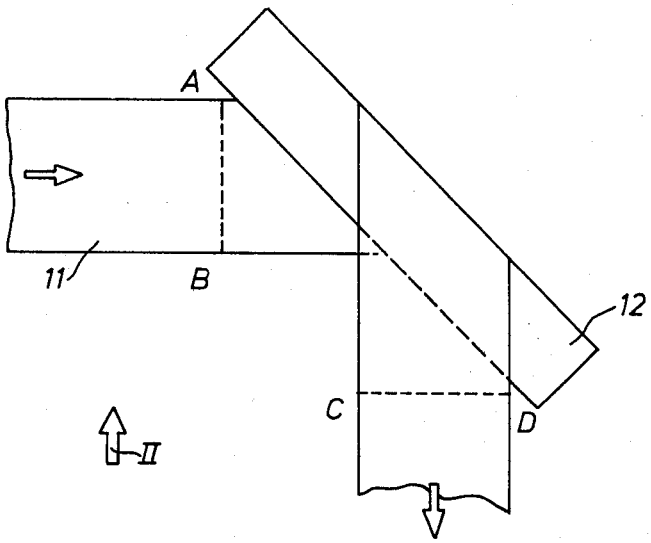

The present invention relates to an apparatus for controlling the path of a travelling web as it leaves an air cushion turning bar.

In the manufacture of webs, particularly webs which are coated with materials subject to scratching, it has been the practice during manufacture to change the direction of web travel by passing the web around an air turning bar. In a customary operation, the web during passage from one coating or drying alley or machine to a parallel coating or drying alley, has its direction changed twice by passing around a spaced pair of angularly arranged turning bars. The web passes around the first turning bar arranged for example at 45° to the direction of web travel in order to change its direction by an angle of 90°. Thus, by passing a second appropriately arranged turning bar, the path of the outgoing web can be laterally displaced in parallel relation to the incoming web. Likewise, suitable configurations of air bars are used to invert moving webs, for instance in coating alleys where the web is not deflected in any lateral direction, but wherein one side of the web is coated and dried during the first half of the path through the installation, and the opposite web side is coated and dried during the second half of the web path.

Highly polished bars that are commonly used as turning bars to change the direction of travel of a web are unsatisfactory for webs which are coated with materials subject to scratching, such as photographic film, because the web surface becomes scratched as it slides around the turning bar. For photographic film, special turning bars, such as air-cushion bars, are used to prevent scratches or other surface damage to the film during changes in direction. These web turning bars are in the form of porous, slotted, perforated or otherwise permeable tubes through which air is passed to maintain a thin cushion of air between the web and the bar. In order to change the direction of the moving web and to maintain even tension across the web, the angle of the incoming web path relative to the axis of the turning bar must be equal to the angle of the outgoing path relative to the axis of the turning bar.

In order to control the position of the web on the turning bar, the incoming web path is controlled by first web guiding means so that the web approaches the bar at the desired lateral position.

Then the outgoing web path is controlled by second web guiding means. One known web guiding assembly comprises a steering frame with a plurality of rollers about which the film is angularly wrapped. The pivoting point of the frame is situated in the entering web plane, and the positioning of the web occurs by means of positive angular displacement.

Another known web guiding means is the so-called Kamberoller guide (Registered Trademark of Fife Manufacturing Company, Inc.), disclosed in U.S. Pat. No. 2,797,091 of Irwin L. File, issued June 25, 1957, which comprises one or more parallel rollers the shaft ends of which are supported on raceway assemblies which are inclined with respect to the lateral web direction.

It has been shown that neither these two nor other known guiding means operate in a satisfactory way for controlling the path of webs that tend to follow a curved direction. Such type of webs are webs in which the thickness, the friction coefficient and/or the length differ from one edge to the other, i.e. measured at different lateral positions.

A web will have a differing length when, if laid flat in a plane, it shows a curvature about an axis normal to that plane. It has been found that curvature radii with a minimum of 1000 meters can occur for web widths between 1.00 and 1.80 m.

Known guiding means distort the tension profile of such a curved web upon redressing the web that follows a skewed path as it passes around the air bar. There are introduced so-called tension chords in the web that run in a direction that is inclined with respect to the longitudinal web axis, and because of this one or both web edges or margins may be dragged into contact with the turning bar, thereby damaging the web.

These tension chords are also introduced into webs wherein the thickness or the friction coefficient differs from one edge of the web to the other, because upon transport of the web while the web is biased with a given longitudinal force, a transverse gradient of longitudinal tension is created.

The present invention aims at providing an apparatus for controlling an outgoing web leaving an air cushion turning bar, which enables a satisfactory control of imperfect webs of the type described.

According to the present invention there is provided an apparatus for controlling the path of a travelling web as it leaves an air cushion turning bar, which apparatus comprises: a roller freely rotatable about and displaceable along a fixed axis and arranged on the web path as the first contact for a web leaving the turning bar; web tension gradient control means arranged on such path downstream of such first roller and operable to alter the gradient across such web of the longitudinal web tension; and steering control means for operating the web tension gradient control means to increase the longitudinal web tension at one edge of the web and simultaneously for axially displacing the first roller to displace the web laterally in the direction such that such one web edge leads the lateral component of the motion of the web.

The controlling effect of the apparatus according to the invention is based on two operations. First, lateral movement is imparted to the first roller whereby correction of the lateral position of the web occurs and, second, the transverse gradient of longitudinal tension is modified whereby a re-orientation of the position of the web on the turning bar occurs thereby to avoid the risk of dragging contact of the web with the surface of the turning bar.

It has been shown that the apparatus according to the invention is particularly suited for controlling webs leaving an air cushion turning bar when the web moves at a relatively great distance from the bearing surface, that is, when the stiffness of the air bearing is small. The stiffness of the air bearing may be expressed as ($\Delta p/-\Delta h$), wherein $\Delta p$ stands for a pressure increase of the air that bears the web, and $-\Delta h$ stands for a corresponding decrease of the distance between the web and the bearing surface. One example of air turning bars wherein, except for the margins, a web is supported at a relatively great distance from the bearing, is disclosed in United Kingdom Patent Specification No. 1,484,998 filed Nov. 29, 1973 by Agfa-Gevaert N.V. relating to an air flotation turner bar, and assigned to the same assignee of the present application.

However, the particular suitability of the apparatus under the just desired conditions does not exclude its use in combination with air cushion turning bars wherein the web moves very closely to the bearing surface and wherein as a consequence thereof the stiffness of the air bearing is relatively large.

Preferred features of the apparatus according to the invention are as follows.

The web tension gradient control means is also effective to laterally displace the web.

The apparatus comprises a second freely rotatable roller which is axially displaceable in order to laterally displace the web, the second roller being disposed as the first roller to enter into contact with the web leaving the web tension gradient control means. The displacements of the second roller may occur simultaneously with and be of the same magnitude as the displacements of the first roller.

The web tension gradient control means comprises a freely rotatable roller which is arranged for bodily swinging about an axis that is parallel with the plane of the web section between the first axially displaceable roller and the web tension gradient control means.

The dynamic friction coefficient of the first roller with respect to the web, is equal to but preferably smaller than the dynamic friction coefficient with respect to the web of the roller that operates a web tension gradient control means. The term "dynamic" stands for the friction coefficient of a roller with respect to the web, measured at the normal transport speed of the web over the roller.

Figure 2:
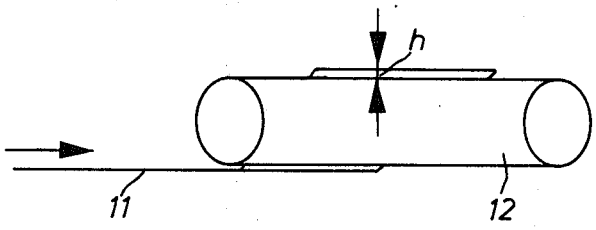
Figure 3:
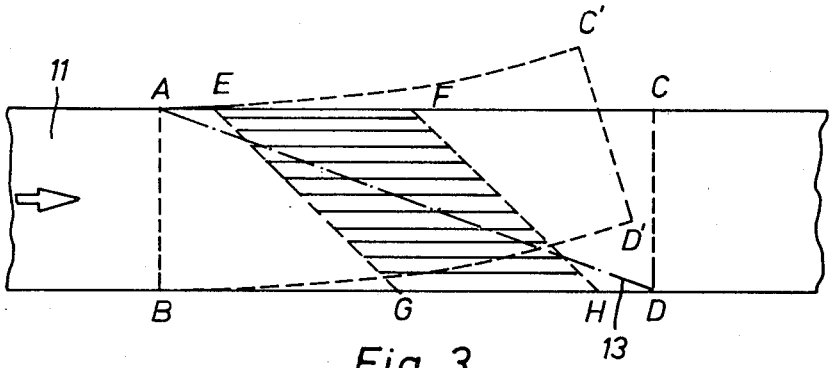
Figure 4:
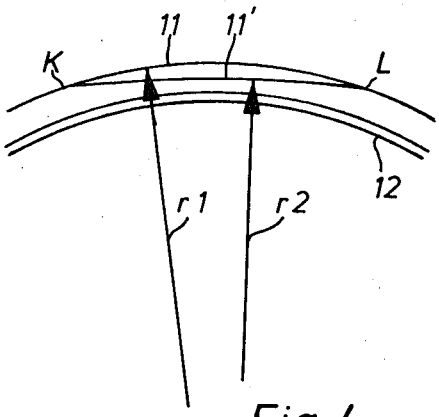
Figure 5:
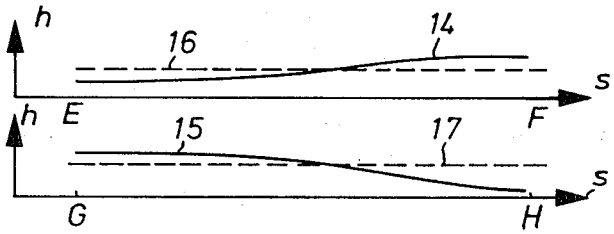
Figure 6:
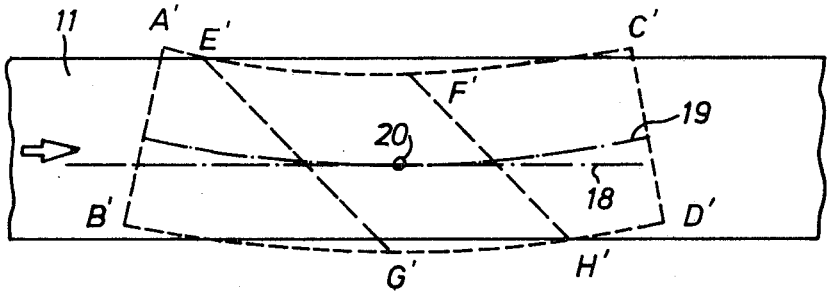
Figure 7:
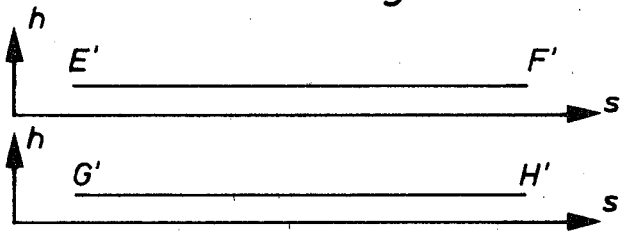
Figure 8:
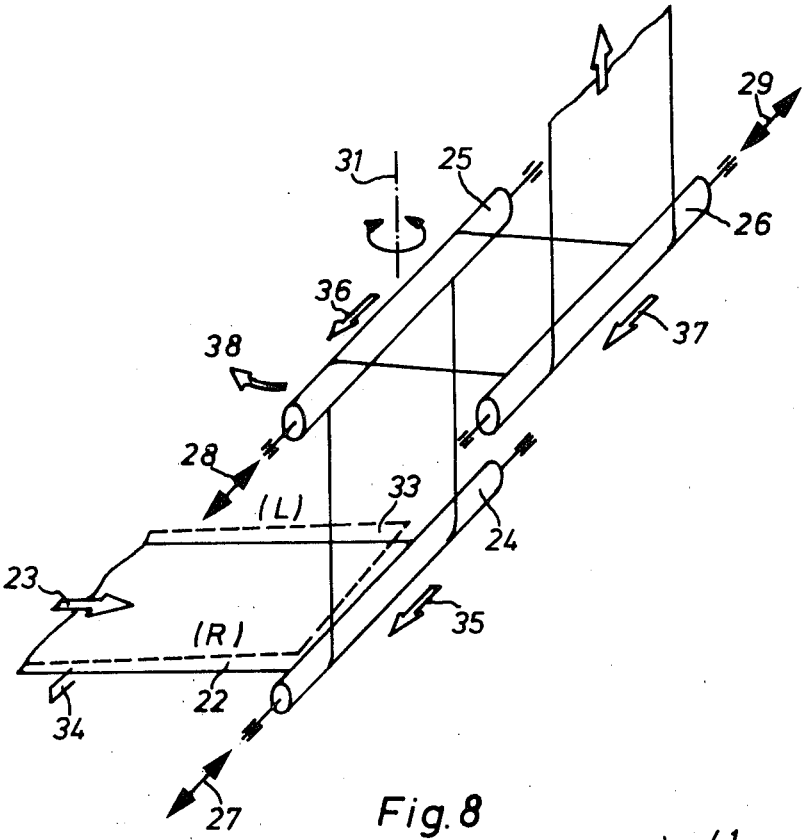
Figure 9:
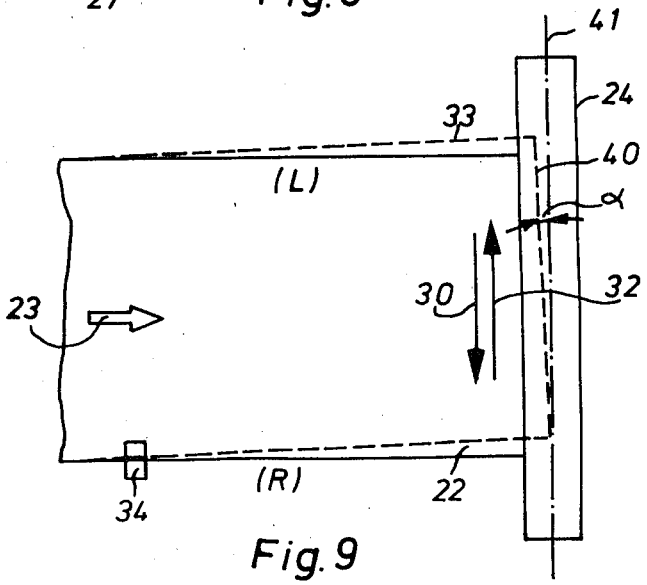
Figure 10:
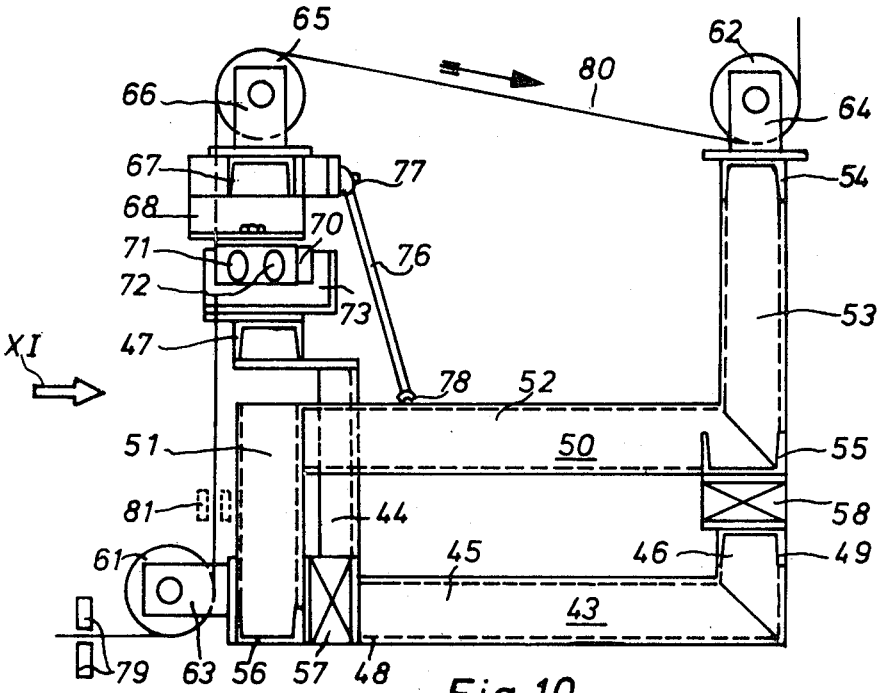
Figure 11:
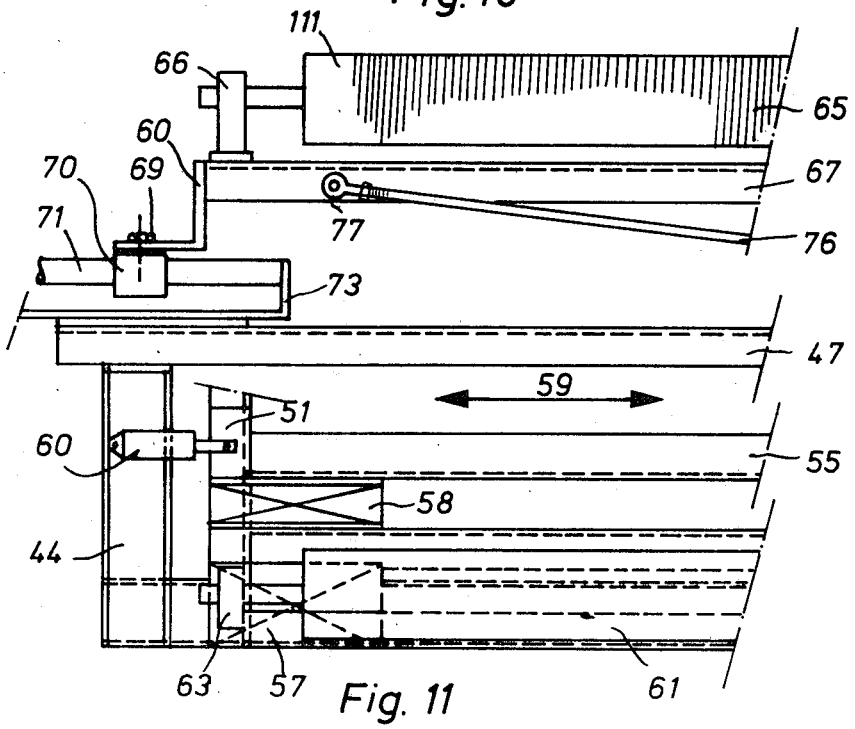
Figure 12:
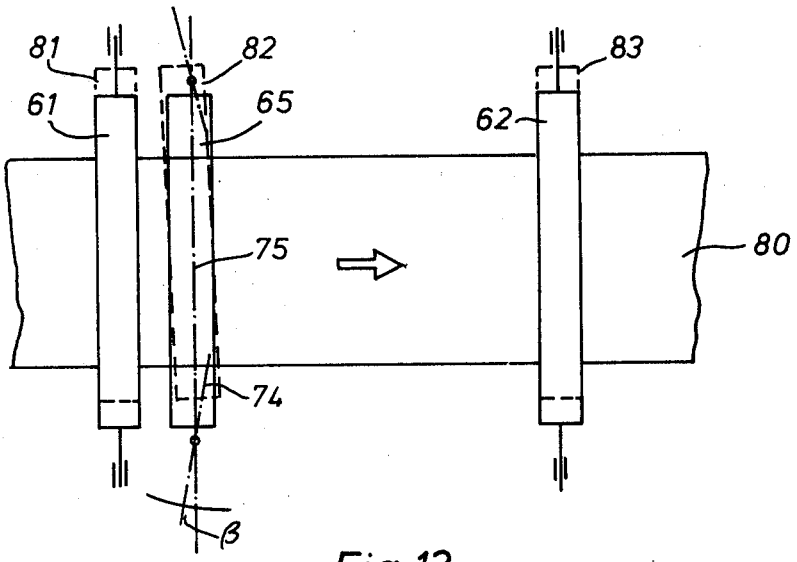
Figure 13:
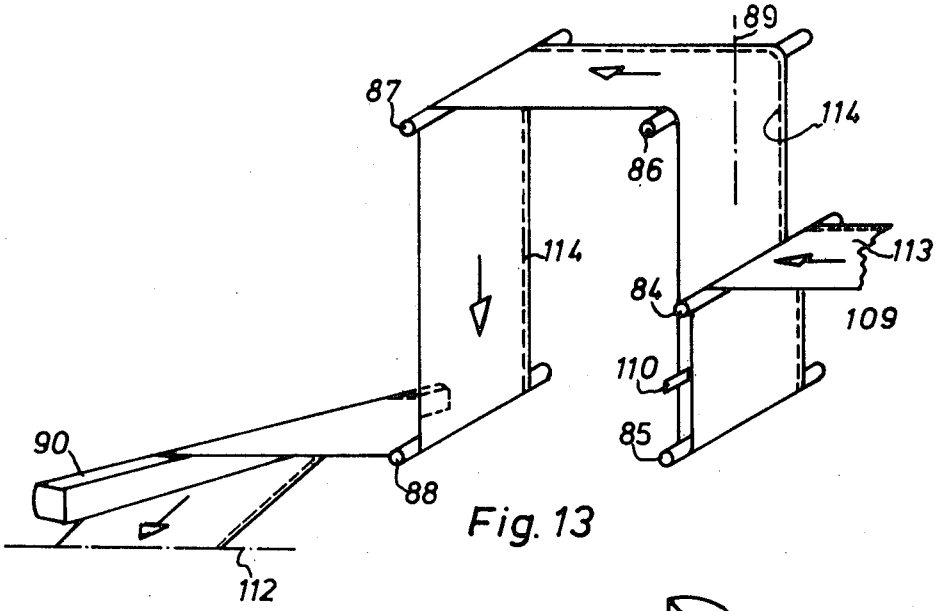
Figure 14:
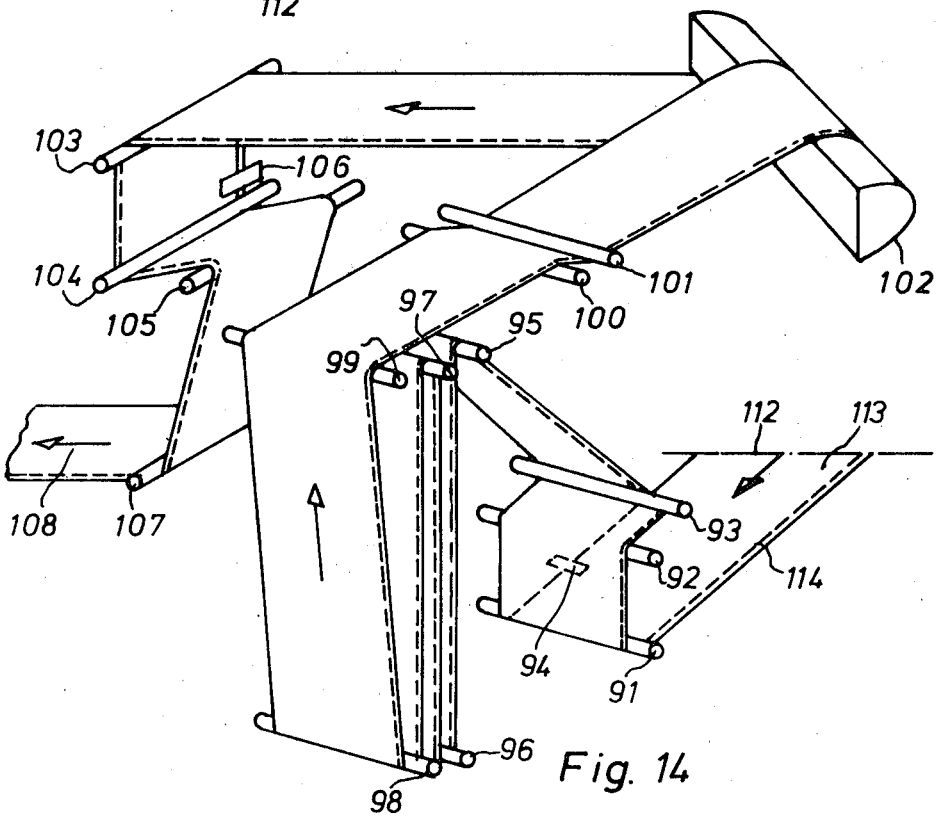

The invention will be described hereinafter by way of example with reference to the accompanying figures wherein:

FIG. 1 is a diagrammatic plan view of an air turning bar around which a web is about 180° to undergo a change in direction of 90°;

FIG. 2 is a view of FIG. 1 from a direction corresponding to the arrow II, FIG. 3 is an illustration of an unfolded web portion, FIG. 4 is a diagram of two differently curved web sections, FIG. 5 is a diagram of the gap between both edges of a curved web and an air turning bar, the web being controlled by a conventional steering system, FIG. 6 is an illustration of an unfolded portion of a curved web, the position of which on the turning bar has been re-oriented in the apparatus according to the invention, FIG. 7 is a diagram of the gap between both edges of a curved web and an air turning bar, the web being controlled in the apparatus according to the invention, FIG. 8 is a diagrammatic perspective view of one embodiment of a steering apparatus according to the invention, FIG. 9 is a plan view of the incoming web section of FIG. 8, FIG. 10 is a side view of the actual construction of an apparatus according to the embodiment of FIG. 8, FIG. 11 is a front view from the direction of the arrow XI of FIG. 10, FIG. 12 is a diagrammatic plan view of the rollers of the apparatus according to FIGS. 10 and 11, FIG. 13 is an illustration of the first half of an installation for inverting a web, and FIG. 14 is the second half of the installation of FIG. 13.

Referring to FIGS. 1 and 2, the direction of travel of a moving web 11 is changed over 90° by folding the web over an air turning bar 12. The angle of the incoming web path to the axis of the turning bar equals the angle of the outgoing web path to the axis of the turning bar, namely 45°.

The air turning bar may be a cylindrical, hollow body, the turning surface of which is provided with a multiplicity of perforations, not shown, through which the air flows to provide an air cushion for the web 11 in the conventional manner. Other configurations of air turning bars may be used equally well. The air to provide the air cushion may be supplied to the ends of the turning bar, as is conventional in the art. The distance between the web and the bearing surface of the turning bar is indicated by h.

The length of web portion which has been indicated by ABCD in FIG. 1, is shown in unfolded condition in FIG. 3. The solid line part of the drawing illustrates a perfectly straight web. The hatched portion EFGH is the area over which the web is supported on the turning bar.

For comparison, the condition of a corresponding portion of an imperfectly curved web is illustrated in a highly exaggerated way for the sake of clarity, by ABC'D'. It will be understood that the outgoing path of such curved web must be corrected if the web is to travel undisturbed over the web transport rollers after leaving the turner bar.

Conventional web guide systems that are placed at some distance downstream of the line CD, endeavour to reposition a curved web in such a way that it coincides with the path of a perfectly straight web. In other words, the system operates basically by causing line C'D' to coincide with CD, and the edges AC' and BD' are tensioned as necessary to bring them into coincidence with AC and BD respectively. The results of this operation is the introduction of inclined tension chords into the web that run parallel with the direction AD indicated by the dash-dot line 13. Because of such tension chords, the edges and more precisely, the marginal zones, of the web no longer remain separated a uniform distance from the supporting surface of the turning bar. This variation in distance as a function of variation in web tension is explained as follows.

The curvature of a web about a turning bar satisfies the equation: $T=p\cdot r$, wherein T is the longitudinal tension in the web in N/m, p is the air pressure in Pascal of the bearing at the position of the web, and r is the radius of curvature of the web around the bearing in m. Since the variations of p are small for distance variations within certain limits, r is almost directly proportional to T. Hence, tension chords, i.e. an increase in longitudinal tension, cause an increase of r, which means a lesser curvature of the web. The fact that a lesser curvature causes the web to move closer to the bearing surface is illustrated in FIG. 4 wherein the positions of two longitudinal web zones between points K and L at different longitudinal web tensions have been illustrated. A first web zone 11 at a normal longitudinal tension has a curvature that is concentric with respect to the cylindrical bearing surface 12, and that is indicated by the curvature radius $r_1$.

A second web zone 11' is at a greater longitudinal tension than zone 11, and so has a lesser curvature than zone 11, as indicated by the curvature radius $r_2$.

The variation in the distance h between the left-hand and the right-hand web edges, respectively and the surface of the bearing resulting from conventional corrective systems has been illustrated on an enlarged scale by the curves 14 for the left-hand and 15 for the right-hand web edge in the diagram of FIG. 5, wherein the ordinate h represents the separation between the web and the turning bar, and s is the distance measured along the periphery of the bar from the initial point of contact. For ease of representation, points E and G have been illustrated at the same position on the abscissa, although in practice they would, of course, be offset. It may be seen by comparing the position of points E and F that the distance the left web edge and the turning bar has increased and from the position of the points G and H the distance from the right web edge has decreased with respect to the nominal distance indicated in broken lines 16 and 17. It may be seen that the variations in distance from E to F and from G to H occur progressively, and it should also be understood that the variation in the transverse direction from G to E and from F to H also occurs progressively.

An approximate illustration of the re-orientation of a curved web over an air turning bar, as it is performed by an apparatus in accordance with the present invention, is illustrated in FIG. 6 for a web section that is again exaggeratedly curved for the sake of illustration. It may be seen that the web is not pulled or forced back to a "straight" condition. Instead its inherent curvature is maintained and the web is only slightly re-oriented so that the tangent 18 to its curved longitudinal axis 19 at approximately the centerpoint 20 of its supported area E'F'G'H' on the turning bar, runs approximately parallel with the longitudinal direction of a perfectly straight web illustrated in solid lines. As a consequence thereof, the web simply follows its "natural" path around the air turning bar and any point of its supported area E'F'G'H' is separated by approximately the same distance from the turning bar surface. This has been illustrated for both edges of the web by the lines E'F' and G'H' of FIG. 7.

It has been shown that the orientation of the curved portion of the web as described with reference to FIG. 6 does not cause any notable tension chords in the web section comprised between the web turning bar and the last web guiding roller disposed upstream thereof.

One embodiment of the apparatus according to the invention whereby the illustrated approximate orientation of the web occurs, and yet whereby the outgoing web path of the apparatus has a direction parallel with that of the web portion illustrated in solid lines, will now be described. The fact that the incoming web, i.e. at A'B'C'D', does not follow such parallel direction is most surprising since it would be expected that a web with its transverse direction inclined as indicated by C'D' would inevitably be influenced in such a way upon its very first contact with a web guiding roller disposed with its axis normal to the web travel direction, that the line C'D' would be displaced towards the right side of the web, i.e. toward the bottom of FIG. 6, and would also become angularly moved so as to be normal to the direction of travel of a straight web. However, any such treatment which endeavours to make the web section in question "straight" would only cause the difficulties mentioned hereinbefore.

Referring to FIG. 8 which illustrates diagrammatically an apparatus according to the invention for controlling a web 22 leaving an air turning bar and advancing in the direction of the arrow 23, the apparatus comprises freely rotatable and parallel rollers 24,25 and 26 that are arranged for axial displacement as indicated by the arrows 27,28 and 29. The roller 25 is further arranged so that it may swing about an axis intersecting its lengthwise axis, such as the vertical axis 31 illustrated, so that the opposite extremities of the roller may swing in a horizontal plane. It should be noted that the axial displacement of the roller 25 is illustrated diagrammatically only. The shaft of roller 25 need not necessarily be able to carry out a sliding movement in its bearings, but the axial component of motion of the roller 25 may also result from the swinging of the roller 25 about a vertical axis that is well remote of the axis of the roller.

The roller 25 is so located with respect to the roller 24 that the web 22 is wrapped at an angle of about 90 degrees around the roller 24. Said angle is not critical and may be smaller or larger than 90 degrees. In the rest position of the apparatus the roller 25 runs parallel with the rollers 24 and 26.

If a web to be controlled should be curved to the left, as illustrated by the web section 33 illustrated in broken lines in the plane of the incoming web 22, then the edge sensor 34 will control an operating mechanism (not shown) that controls the position of the rollers, in such a way that the three rollers 24, 25 and 26 are displaced towards the right side (R) of the moving web, as indicated by the arrows 35, 36 and 37 in FIG. 8, and the roller 25 is swung in the direction of the arrow 38 so as to increase the web tension at the right side (R) of the web by increasing the length of the web path between the rollers 24 and 26 at said right-hand position.

The effect of the described operation is as follows. First, the axial displacement of the rollers 24, 25 and 26 causes an instant displacement of the curved web in the direction of its right side (R) so that the right web edge remains within the sensing area of the edge sensor 34.

Second, swinging of roller 25 causes a transverse gradient of longitudinal tension in the web, the greater tension being situated at the right side of the web 22, so that this web side is pulled at a greater rate than the left side (L), whereby the web will maintain a curved position.

Referring to FIG. 9 which is a plan view looking down at the entering web section in FIG. 8, it may be seen that the front edge 40, i.e. a line normal to the longitudinal centerline of the curved web 33, centerline makes an angle $\alpha$ with respect to the axis 41 of the roller 24. A web engaging a roller in the illustrated way would hitherto be displaced on the roller 24 in the direction of the right side of the roller, i.e. in the direction of the arrow 30, until the front edge 40 of the web would run parallel with the roller axis 41. Whereas such redressing of a "straight" web is entirely acceptable in practice, this treatment would destroy the satisfactory guidance of a 'curved' web about an air turning bar as diagonal tension chords would be introduced into a curved web as described already.

The increased longitudinal tension at the right side of the web in accordance with the invention, causes a curving tendency of the web from the right towards the left side, so that the natural curvature of the web is maintained and a lateral component of force is created in the web which tends to displace the web on the roller 24 towards the left direction, i.e. according to the arrow 32 of FIG. 9.

This lateral component of force causes a continuous lateral slipping of the web on the roller 24 and thus balances the force which is created by the rolling of the web on the roller at a certain angle and which tends to displace the web in the direction of the arrow 30 towards the right side (R). This balance of lateral forces has the result that a curved web continues to follow a curved path, as illustrated by the position in broken lines 33, the right lateral edge of the web being maintained at the position at the place of the edge sensor 34.

It should be understood that the angular movement of the roller 25 in order to control the tension gradient across the web may occur by pivotation about other axes than the axis 31 illustrated. For instance, the roller may be arranged for bodily angular displacement by providing the roller with bearings capable of carrying out axial as well as radial displacements with respect to the roller so that an imaginary axis of pivotation of the roller is obtained.

FIGS. 10 to 12 illustrate constructional details of a practical embodiment of apparatus which operates according to the principles described with reference to FIGS. 8 and 9, and which yields very satisfactory results in practice.

Referring to FIG. 10 which is a side view and FIG. 11 which is a front view from the direction of the arrow XI of FIG. 10, the apparatus comprises a stationary frame 43 having uprights 44 and 46 interconnected by horizontal struts 45 and carrying three horizontal beams 47, 48 and 49, and a horizontally movable frame 50 having uprights 51 and 53 interconnected by horizontal struts 52 and carrying three horizontal beams 54, 55 and 56. The movable frame 50 is journalled on roller bearings 57 and 58 for to and fro movement in a direction which is transverse with respect to the path of a web moving through the apparatus, i.e. a direction according to the arrow 59 in FIG. 11. Movement of the frame 50 is controlled by an air motor 60 which connects an upright 51 of the movable frame 50 with an upright 44 of the stationary frame 43.

The apparatus comprises three freely rotatable rollers. The rollers 61 and 62 which are journalled in parallel in bearings 63 and 64 mounted on the beams 56 and 54 of the movable frame 50, and the roller 65 which is journalled in bearings 66 mounted on a further horizontal beam 67.

The rollers 61 and 62 are smooth-surfaced rollers having a high gloss chrome finish as usual in the art, whereas the roller 65 is a chrome-plated roller the peripheral surface of which has been provided with a spiral groove 111 thereby to promote the escape of air that is dragged by the moving web in the nip between the web and the roller. As a consequence thereof, the dynamic friction coefficient between the rollers 61 and 62 versus the web 80, is smaller than the dynamic friction coefficient between the roller 65 and the web.

The beam 67 is arranged as follows for displacement in a horizontal plane. Each end of the beam is provided with an angled plate 68 which is pivotably fitted by means of a pin 69 to a slide member 70. Each slide member 70 is slidably supported on two parallel rods 71 and 72 that are mounted in a bracket 73. The two brackets 73 (one for each end of the roller 65) are mounted with their longitudinal axis 74 at a small inclination $\beta$ to the longitudinal direction of the beam 47, so that the rods 71 and 72 make an angle $\beta$ with respect to the transverse direction 75 of the apparatus as illustrated diagrammatically in FIG. 12.

The longitudinal axes of the two brackets 73 are thus inclined to the longitudinal direction of the beam 47 in opposite senses so that said two axes are not parallel. FIG. 12 is a diagrammatic plan view of the rollers of the apparatus of FIGS. 10 and 11, wherein there has been left some horizontal separation between the rollers 61 and 65 for the sake of clarity. The beam 67 is connected with the movable frame 50 through a rod 76 which is pivotally fitted to the beam 67 at the point 77 and likewise pivotally fitted to the frame 50 at the point 78 of the strut 52. The rod 76 extends almost horizontally over the full width of the apparatus as indicated in FIG. 11, and therefore the position of the rod in FIG. 10 should be not misinterpreted.

The beam 67 is arranged to have the roller 65 run parallel with the rollers 61 and 62, when the apparatus is in its rest or dead center position.

If an edge sensor 79 detects a deviation of the web edge from the correct running position, then an error signal is produced that controls after suitable amplification the motor 60 in such a way that the movable frame 50 is moved in that direction wherein the rollers 61 and 62 laterally displace the web until the web edge has resumed the correct position in respect of the edge sensor 79.

Thus, if in the illustration of FIG. 12, the position of the web 80 would be displaced toward the bottom of FIG. 12 from the position illustrated in solid lines, then the rollers would be displaced in the direction of their upper extremity, as illustrated by the broken lines 81, 82 and 83. Whereas the rollers 61 and 62 carry out a truly axial displacement, the roller 65 undergoes also an angular displacement in addition to the axial displacement. This additional angular displacement is a direct consequence of the inclined mounting of the guides for the roller bearings. The roller 65 is a cambering roller known in the art as a Kamberoller (registered Trademark). The distance between the rollers 65 and 62 will be increased at the upper ends of the rollers and correspondingly decreased at the lower ends of the rollers as seen in FIG. 12, so that a corresponding lateral gradient of longitudinal tension is established in the web, the greater tension being at the upper web edge as seen in FIG. 12.

The following data illustrate the apparatus that was successfully used for the control of the path of a web over an air turning bar that deflected the web path over 90°.

Apparatus:
- length of rollers 61, 62 and 65: 2000 mm
- diameter of the rollers 61, 62 and 65: 100 mm
- peak to peak axial displacement of the rollers: 100 mm
- angle $\beta$: 15 degrees
- maximum angular displacement of roller 65: 1.5 degrees Air turning bar:
- radius: 200 mm
- air cushion pressure: 300 Pascal Web:
- material: polyethylene terephthalate
- width: 1.73 m
- thickness: 0.18 mm
- web "curvature" that was satisfactory controlled: 1,700 m radius of curvature
- longitudinal web tension: $1560.10^3$ $N.m^{-2}$.

The following points should be considered in connection with the described apparatus.

The edge sensor 79 may have other positions than the illustrated one. One alternative position is the position 81 illustrated in broken lines in FIG. 10. Other possible positions are further towards the roller 65, between the rollers 65 and 62, and even downstream of the roller 62. A sensor position most close to the roller 61 usually gives best results.

The rotation of the rollers may raise problems when relatively high web speeds, for instance web speeds higher than 80 $m.s^{-1}$, are applied. Air which is entrained by the web between the rollers and the wrapped web area, causes slipping of the rollers and decreases the efficiency of the apparatus. Known measures such as increasing the friction coefficient of the rollers, providing the peripheral surface of the rollers with a plurality of axial or helicoidal grooves, etc., may be taken. Primarily, the roller 65 deserves attention for the application of such measures. Consequently it is indeed desirable that the coefficient of friction of the web tension controlling roller 65 is at least equal to and preferably higher than the coefficient of friction of the web position controlling rollers and, above all, of the roller 61. As a matter of fact, it is necessary that the web should be capable of continuously laterally slipping on the roller 61 as mentioned already. Such lateral slipping is not desired on the roller 65 if satisfactory operation of the apparatus is to be achieved.

An installation for inverting a moving web, wherein two air turning bars are used each one associated with a web control apparatus according to the invention, will now be described with reference to FIGS. 13 and 14 wherein FIG. 13 is the first half of the installation and FIG. 14 the second half thereof, the dash and dot line 112 being the common section line of the web in both Figs.

A web 113 is passed over rollers 84 and 85 to a conventional apparatus for steering the lateral web position at an edge sensor 110. The steering apparatus comprises three parallel rollers 86, 87 and 88 that are swingable as one unit about a vertical axis 89. The direction of web travel is changed over 90° by a first air turning bar 90. The position of the web on the air turning bar 90 is controlled by the apparatus according to the invention that comprises the rollers 91, 92 and 93. Rollers 91 and 93 are axially displaceable whereas roller 92 is axially and angularly displaceable as illustrated in FIGS. 10 and 11. An edge sensor 94 controls the operation of the rollers 91 to 93. The web is then passed over rollers 95 to 101 to a second air turning bar 102 that changes the direction of web travel a second time over 90°. The former upper side of the web has now become the lower side. This may most easily be followed by considering the interchanging of the position of both web edges. One web edge has been doubled by a broken line 114 for the ease of verification. This line has been shown at both sides of the web.

The position of the web on the second air turning bar 102 is controlled by a second apparatus in accordance with the invention, and which comprises rollers 103, 104 and 105 that operate in the same way as do the rollers 91, 92 and 93, and that are controlled by an edge sensor 106. The web is finally pulled over a freely rotatable roller 107 with fixed axis, for transport to a further destination. The lateral position of the outgoing web at the arrow 108 coincides with the position of the incoming web at 109.

The purpose of the rollers 95 to 99 is to provide a lateral constraint for the web whereby the possible effect of the steering of one air turning bar on the other bar may be isolated. Such additional constraint is not indispensable. Its necessity is dependent on the web curvature that may be expected, the web tension, the configuration of the air turning bars, etc.

The invention is not limited to the described embodiments. It will be understood that the apparatus according to the invention may as well be used for the control of webs passing over so-called "straight" air cushion bars whereby the direction of travel of a web is not changed in a lateral direction but only in a plane normal to the plane of the incoming web section and comprising the longitudinal axis of the web. Usually, the problems met with the guidance, of imperfect webs as described hereinbefore, are less with such straight air cushion turning bars than they are with the described bars for laterally changing the direction of travel of a web.

The means for web tension gradient control may be rollers other than the described cambering roller. For instance, a roller comprising a flexible axle and a flexible tubular sleeve may be used. Control of the position of one or both ends of the flexible axle may change the length of the web path between the first and the second axially displaceable roller for laterally displacing the web. Another alternative solution comprises the use of a roller with a rigid shaft and an inflatable mantle so that the diameter thereof may be progressively varied from one end of the roller to the other end.

We claim:

1. Apparatus for correcting the path of a travelling web including an imperfect curved web as it leaves an air cushion turning bar, characterized in that such apparatus comprises: a freely rotatable roller, means supporting said roller for bodily axial displacement along a fixed axis, said roller being arranged on said web path as the first contact for a web leaving the turning bar, a second freely rotatable roller downstream of said first and defining between them a stretch of the path which makes an angle with the upstream adjacent portion of said path and is generally perpendicular to the adjacent portion of said path downstream of said second roller, means mounting said second roller for pivotal movement about an axis generally perpendicular to said adjacent portion of said path downstream of said second roller, means for detecting a lateral deviation by said web from its correct path, and operating means actuated in response to said detecting means for effecting axial bodily displacement of said first roller in a direction opposite to said deviation and for substantially simultaneously tilting said second roller about said axis to differentially lengthen the path of the edge margin on the side of the web opposite the direction of deviation.

2. Apparatus according to claim 1, wherein said mounting means for said second roller also supports the same for axial bodily displacement and said operating means also effects axial displacement of said second roller.

3. Apparatus according to claim 1, which comprises a third freely rotatable roller, means supporting the same for axial displacement in order to laterally displace the web, said second roller being disposed downstream of said tiltable second roller in contact with the web, and said operating means is effective to also cause axial displacement of said third roller.

4. Apparatus according to claim 3, wherein said operating means carries out said displacements of said first and third rollers simultaneously and in the same magnitude.

5. Apparatus according to claim 1, wherein said tiltable roller is a cambering roller.

6. Apparatus according to claim 1, wherein said web is wrapped about 90 angular degrees around said second tiltable roller.

7. Apparatus according to claim 1, wherein the friction coefficient of said first roller with respect to the web is not higher than equal to the friction coefficient of the second tiltable roller.

8. Apparatus according to claim 1, wherein the path of the web approaching the turning bar makes about a 90° angle to the path of the outgoing web, and each of said paths intersects the axis of the turning bar at an angle of about 45°.

9. Apparatus according to claim 1, wherein said detecting means comprises an edge sensor for sensing the lateral position of a web edge downstream of said turning bar.

10. Apparatus according to claim 9, including a second air turning bar for changing the direction of travel of the web through 90°, and including lateral constraint means for the web between the second air turning bar and said tiltable second roller.

* * * * *